United States Patent [19]

McClure

[11] 4,121,657

[45] Oct. 24, 1978

[54] POSITION INDICATOR FOR DOWNHOLE TOOL

[75] Inventor: Tommy L. McClure, Houston, Tex.

[73] Assignee: Eastman Whipstock, Inc., Houston, Tex.

[21] Appl. No.: 797,253

[22] Filed: May 16, 1977

[51] Int. Cl.[2] ..... E21B 43/00

[52] U.S. Cl. ..... 166/66; 166/255; 175/45

[58] Field of Search ..... 175/40, 45, 46, 50, 175/4.51; 166/66, 255, 65 M, 60; 340/18 R; 285/93, DIG. 21; 33/300, 333; 324/200, 207, 221

[56] References Cited

U.S. PATENT DOCUMENTS

| | | | |
|---|---|---|---|
| 3,052,309 | 9/1962 | Eastman | 175/45 |
| 3,414,071 | 12/1968 | Alberts | 175/4.51 |
| 3,434,046 | 3/1969 | Wilson et al. | 175/45 |
| 3,465,836 | 9/1969 | Fields | 175/4.51 |
| 3,656,562 | 4/1972 | Baugh | 175/4.51 |

*Primary Examiner*—Ernest R. Purser
*Assistant Examiner*—Richard E. Favreau
*Attorney, Agent, or Firm*—Jennings B. Thompson

[57] ABSTRACT

Apparatus is disclosed to indicate at the surface when a tool lowered into a well bore on an electric cable is properly positioned in a downhole housing. The tool has a key slot and a muleshoe is carried by the tool to engage a key located on the housing and to guide the key into the key slot to properly position the tool. A sensing coil is carried by the tool and positioned for its magnetic field to pass through the key slot. Circuit means monitor the magnetic field and indicate at the surface when the key has been properly positioned in the slot.

5 Claims, 5 Drawing Figures

POSITION INDICATOR FOR DOWNHOLE TOOL

This invention relates to apparatus for indicating at the surface when a tool lowered into a well bore is in the desired position in a housing or seat located in a well bore.

This invention is particularly useful with tools that are lowered into the drill pipe to indicate at the surface the direction the well bore is being drilled, the angle of the well bore with respect to vertical, and the rotation or roll angle of the drilling assembly due to the torque of a downhole motor. For these tools, it is necessary that they be properly positioned on the seat provided therefor so that they will have a predetermined orientation with respect to the drilling assembly. Otherwise, the information transmitted to the surface is erroneous.

Therefore, it is an object of this invention to provide apparatus for indicating at the surface when a tool is positioned with the proper orientation in a housing provided therefor in the drilling assembly.

It is another object of this invention to provide apparatus for indicating at the surface the relative position of a key slot carried by a tool and a key located on an orienting seat for the tool as the tool moves into position on the seat.

These and other objects, advantages, and features of this invention will be apparent to those skilled in the art from a consideration of this specification including the attached drawings and appended claims.

Figure 1:
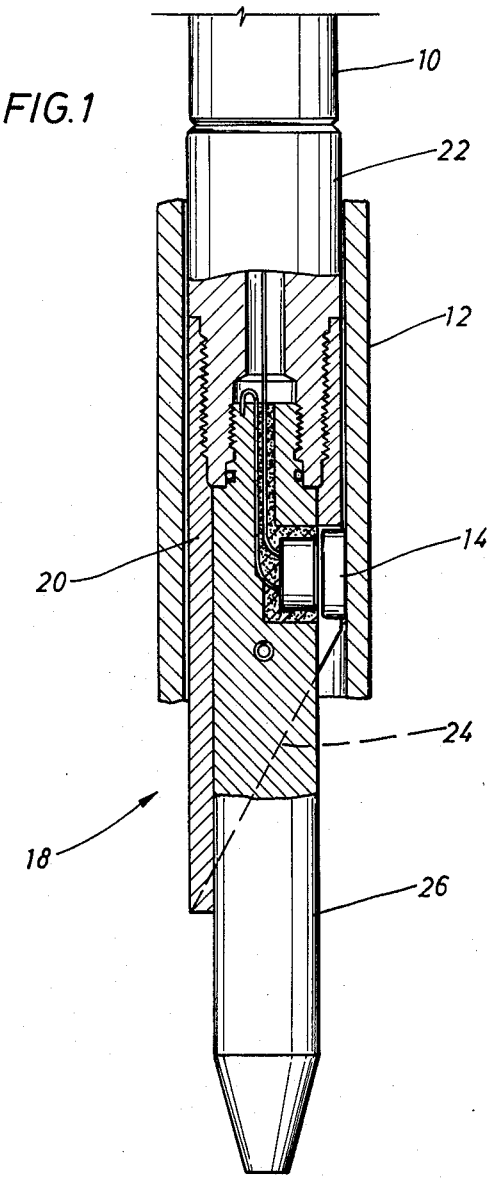
FIG. 1 is a view, partly in elevation and partly in section, of the preferred embodiment of the apparatus of this invention with the key slot carried by a downhole tool properly positioned on a key mounted on an orienting housing, provided in the drill pipe to receive the tool.
Figure 2:
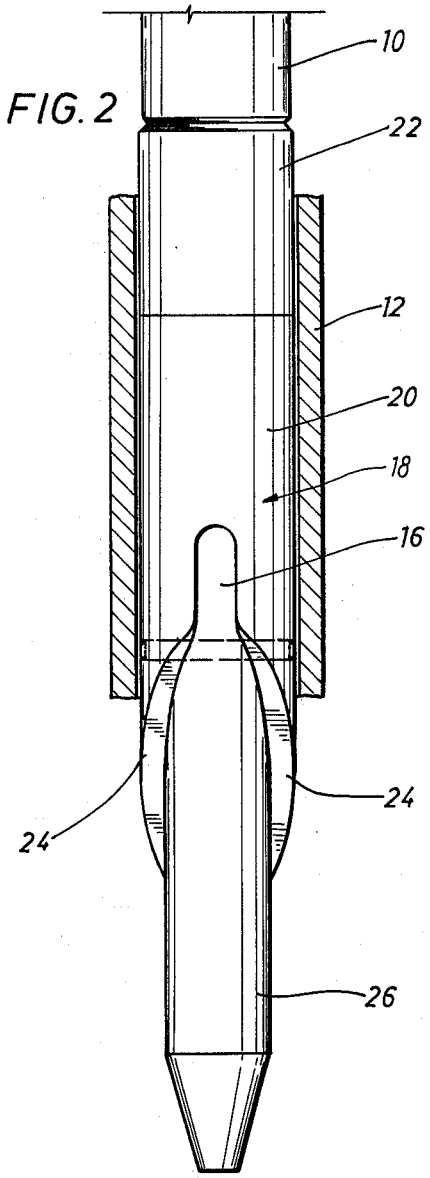
FIG. 2 is a side view of the apparatus of FIG. 1.
Figure 3:
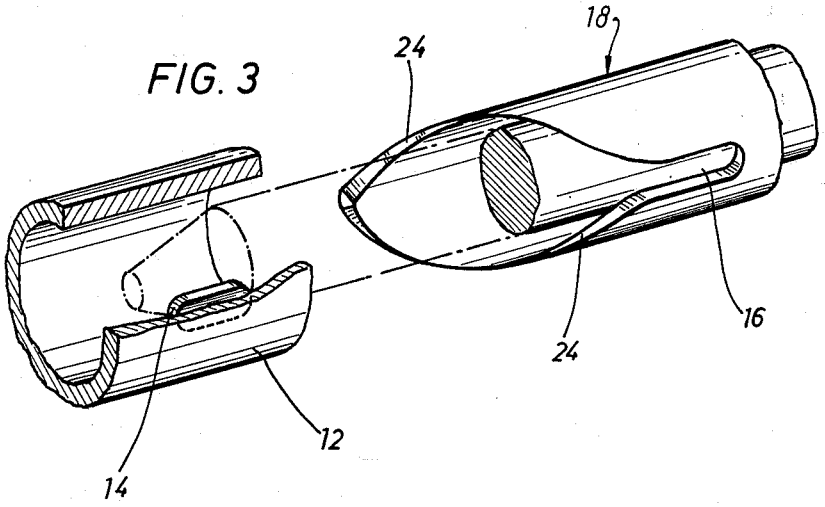
FIG. 3 is an isometric view of the tool as it approaches the orienting housing or seat provided therefor.
Figure 5:
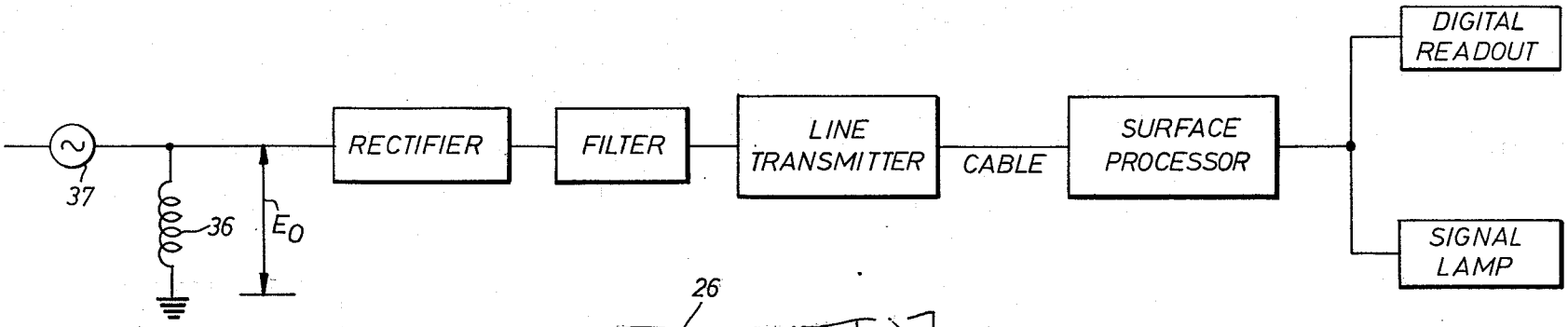
FIG. 5 is a block diagram of the electrical circuit employed to indicate at the surface when the tool is properly positioned on the seat provided therefor.

Only the portion of the tool that carries the apparatus of this invention is shown in the drawings. In the embodiment shown, this is the lower portion of the tool although this would not necessarily always be the case, as the apparatus could be positioned anywhere along the tool.

The tool to be positioned includes tubular housing 10. In the drawings, only the lower portion of housing 10 is shown. The sensing equipment desired for the particular tool, such as means to indicate the orientation of a downhole drilling assembly, may be located in this housing. If the tool is to be lowered from the surface, housing 10 can be attached at its upper end in the conventional manner to an appropriate electrical cable (not shown), which can be used for conducting electrical signals from the instruments in the housing to the surface and for supplying power to the tool. Usually, as for example with a drilling guidance tool, the tool will be lowered through the drill pipe until it is properly positioned in housing 12 provided therefor in the drill pipe. The housing is designed to orient the tool in a predetermined direction. As explained above, in directional drilling the tool must have a known orientation with respect to the drilling assembly.

One system that is commonly used to accomplish this is to locate key 14 on the inside of housing 12 so that it engages key slot 16 on the tool thereby limiting further downward movement of the tool and also insuring that the tool is oriented along its longitudinal axis in the desired predetermined angular relationship to the drilling assembly. Muleshoe assembly 18 is provided to guide the key slot into position to receive key 14. This includes outer sleeve 20 attached to housing 10 through sub 22. Sleeve 20 has oppositely inclined guide surfaces 24 which converge in the well known manner so that when key 14 engages the inclined surfaces, it will cause the tool to rotate as it moves downwardly until key slot 16 is in vertical alignment with key 14 to allow the key to move into the slot. The muleshoe assembly also includes guide nose 26 which comprises a cylindrical member also connected to housing 10 through sub 22, as shown in FIG. 1.

In accordance with this invention, apparatus is provided for indicating at the surface when the key is seated in the key slot. In the embodiment shown, body 30 of highly permeable ferromagnetic material is positioned in slot 32 of member 26. Body 30 is held in the slot by potting material indicated by the number 34. Body 30 is provided with grooves or slots in which is located sensing coil 36. The coil is arranged so that when provided with electrical current, a magnetic field will be established that extends and includes key slot 16, or at least a substantial portion thereof.

Figure 4:
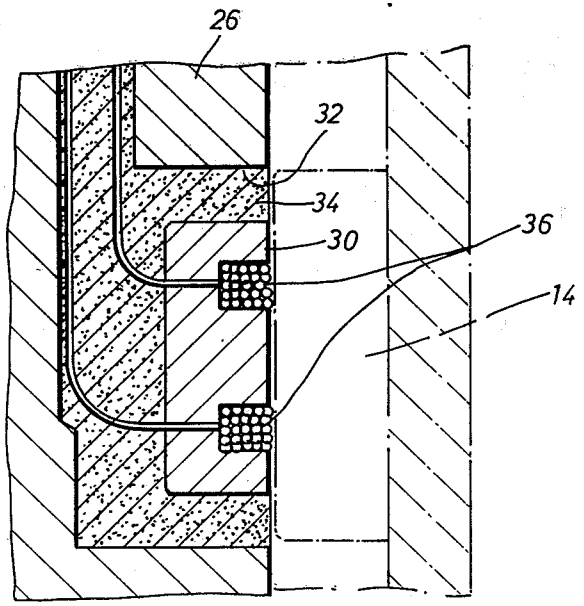
FIG. 4 is a cross-sectional view on an enlarged scale of the sensing coil carried by the downhole tool.

As shown in FIG. 1, when the tool is in position properly oriented on the seat with key 14 located in keyway 16, key 14 will be adjacent to the electromagnet formed by body 30 and coil 36. When key 14 is not positioned in the key slot, the path of the flux from coil 36 outside of body 30 travels through air or the liquid that happens to be in the drill pipe as the tool is being lowered therein. The permeability of this fluid is known generally, and with a given A.C. current supplied to coil 36 by generator 37 there will be a predetermined A.C. voltage across the coil. This is shown in FIG. 4 as $E_o$. As key 14 moves into key slot 16, however, the permeability of the path for the flux from the coil is changed. This can be changed in varying amounts and degrees. In the preferred embodiment, key 14 is made of a highly permeable ferromagnetic material so that a path of low resistance is provided to the flux from the coil. This causes a change in $E_o$, the voltage across coil 36, as key 14 moves upwardly in key slot 16.

As shown in FIG. 4, the voltage signal is rectified, filtered and shaped as desired and transmitted to the surface through the cable. At the surface, the signal can be converted to digital readout to indicate the relative position of the key in the slot and also a signal lamp can be designed to turn on when the voltage reaches a preselected amount to indicate that the key has seated in the upper end of the slot and the tool is in the desired position.

In one embodiment of this invention, the digital readout was designed to read arbitrarily the number 110 as the tool was being lowered into the well bore through the drilling mud, and then the digital readout would drop to 60 when the key was completely fully seated in the key slot and further downward movement of the tool was prevented. At the same time, the signal lamp indicated in FIG. 4 would turn on. The digital readout gives the operator an indication of when the key is moving into the key slot and also when it has reached the desired position in the key slot. The signal lamp simply provides an alternate surface indication that the tool is properly seated.

From the foregoing, it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the apparatus of this invention without departing from the scope thereof, it is to be understood that all matter herein set forth or shown in the accompanying drawings is to be interpreted as illustrative and not in a limiting sense.

The invention having now been described, What is claimed is:

1. Apparatus for indicating at the surface when a downhole tool is properly oriented in a housing provided in the well bore to receive the tool, comprising orienting means on the housing and the tool for orienting the tool in the desired position in the housing when the tool moves into position in the housing, said orienting means including a key slot on said tool and a key on the housing for engaging the key slot on the tool, a guide surface for engaging the key to guide the key into the slot, and electrical circuit means carried by the tool for transmitting a signal to the surface to indicate at the surface when the key is seated in the key slot.

2. The apparatus of claim 1 in which the key slot has an end wall at its upper end to engage the key and limit the downward movement of the tool.

3. The apparatus of claim 1 in which the electrical circuit means includes a magnet carried by the tool and positioned for the magnetic field of the magnet to pass through the key slot and in which the key is made of a ferromagnetic material to cause changes in the magnetic field of the magnet when the key moves into the key slot, and means responsive to the change in the magnetic field for transmitting a signal to the surface for indicating at the surface when the key is positioned properly in the key slot.

4. The apparatus of claim 3 in which the electrical circuit means includes means for indicating at the surface the relative position of the key in the key slot as the key moves along the key slot to its seated position.

5. Apparatus for indicating at the surface when a downhole tool is properly oriented on a seat provided therefor comprising means for orienting said tool in a known position in a remote location, said means including a key slot and an inclined surface carried by the tool leading upwardly to the key slot and a key located on the seat for engaging the inclined surface and rotating the tool into position for the key to enter the key slot, and means carried by the tool to indicate at the surface when the key is positioned in the key slot, and means including a coil, means for supplying the coil with an electrical current for producing a magnetic field that passes through the key slot, and circuit means for sensing the predetermined change in the magnetic field when the key moves into position in the key slot and for indicating at the surface when the key is properly oriented.

* * * * *